US009376240B1

(12) United States Patent
McMurray et al.

(10) Patent No.: US 9,376,240 B1
(45) Date of Patent: Jun. 28, 2016

(54) CUTTER CUP HAVING SEAL CUTTER AND DEPRESSOR FIN

(71) Applicant: TUF-TITE, INC., Lake Zurich, IL (US)

(72) Inventors: Greg McMurray, Des Plaines, IL (US); Wayne A. Huerth, Prairie Grove, IL (US); Gordon D. Wade, Wauconda, IL (US)

(73) Assignee: TUF-TITE, INC., Lake Zurich, IL (US)

( * ) Notice: Subject to any disclaimer, the term of this patent is extended or adjusted under 35 U.S.C. 154(b) by 196 days.

(21) Appl. No.: 14/015,393

(22) Filed: Aug. 30, 2013

Related U.S. Application Data

(60) Provisional application No. 61/694,964, filed on Aug. 30, 2012, provisional application No. 61/754,145, filed on Jan. 18, 2013.

(51) Int. Cl.
*B65D 51/22* (2006.01)
*B65D 41/34* (2006.01)

(52) U.S. Cl.
CPC ..... *B65D 41/3461* (2013.01); *B65D 51/223* (2013.01)

(58) Field of Classification Search
CPC ..... B65D 51/22; B65D 51/223; B65D 2251/0015; B65D 2251/0093; B65D 41/3461
USPC ..... 215/228, 257, 226; 206/222; 220/278, 220/212, 277, 281, 80, 81, 83, 85
See application file for complete search history.

(56) References Cited

U.S. PATENT DOCUMENTS

| | | | |
|---|---|---|---|
| 2,970,711 | A | 2/1961 | Goldstein |
| 3,581,605 | A | 6/1971 | Taylor |
| 3,931,905 | A | 1/1976 | Shumway et al. |
| 4,340,147 | A | 7/1982 | McIntosh |
| 4,634,013 | A | 1/1987 | Bar-Kokhba |
| 4,709,822 | A | 12/1987 | Vataru |
| 4,993,569 | A | 2/1991 | Osip et al. |
| 5,090,582 | A | 2/1992 | Art et al. |
| 5,148,937 | A | 9/1992 | Huard |
| 5,477,972 | A | 12/1995 | Lester |
| 5,505,326 | A | 4/1996 | Junko |
| 5,566,845 | A | 10/1996 | Frank |
| 5,709,311 | A | 1/1998 | Butler et al. |
| 5,797,506 | A | 8/1998 | Lehmkuhl et al. |
| 6,024,234 | A | 2/2000 | Rink et al. |

(Continued)

OTHER PUBLICATIONS

Non-Final Office Action, U.S. Appl. No. 13/781,010, mailed Dec. 10, 2014.

(Continued)

*Primary Examiner* — Anthony Stashick
*Assistant Examiner* — Ernesto Grano
(74) *Attorney, Agent, or Firm* — Marshall, Gerstein & Borun LLP

(57) ABSTRACT

A cap for a bottle having a safety seal over its mouth, the cap provided with one or more integral seal-cutting fins to facilitate removal of the safety seal. The cap further includes mouth alignment ribs and may include one or more depressor fins. The cap may have an inner stage and an outer stage. When inverted, the cap may be positioned on the lip of the mouth of a heat induction sealed bottle. Upon application of downward force and rotation of the cap, the seal-cutting fins score or cut the safety seal to facilitate removal of the seal. The depressor fin(s) prevents the entire circumference of the seal from being scored or cut, and therefore reduces the risk that the seal will fall into the bottle during removal of the seal.

22 Claims, 10 Drawing Sheets

(56) References Cited

U.S. PATENT DOCUMENTS

| | | | |
|---|---|---|---|
| 6,039,198 | A | 3/2000 | Wolfe et al. |
| 6,089,391 | A | 7/2000 | Abelbeck et al. |
| 6,182,845 | B1 | 2/2001 | Wolfe et al. |
| 6,223,924 | B1 | 5/2001 | Ek et al. |
| 6,296,130 | B1 | 10/2001 | Forsyth et al. |
| 6,386,385 | B1 | 5/2002 | Amanat et al. |
| 7,083,058 | B2 | 8/2006 | Perry et al. |
| 7,410,071 | B1 | 8/2008 | Seib et al. |
| 7,942,284 | B2 | 5/2011 | Amanat et al. |
| 8,079,485 | B2 | 12/2011 | Berndt |
| 8,205,761 | B2 | 6/2012 | Stull, Sr. et al. |
| D712,740 | S | 9/2014 | Antal et al. |
| 2006/0273091 | A1 | 12/2006 | Hornke et al. |

OTHER PUBLICATIONS

U.S. Appl. No. 13/781,010, filed Feb. 28, 2013.

CUTTER CUP HAVING SEAL CUTTER AND DEPRESSOR FIN

FIELD OF THE DISCLOSURE

This disclosure relates generally to caps for bottles and, more specifically, to caps having integral structure to impart score lines to safety seals to facilitate removal of the safety seal provided over the mouth of a bottle.

BACKGROUND

A variety of bottled products, such as windshield washer fluid, are sold with spill-proof and tamper-resistant heat induction safety seals that cover the mouth of the bottle. Heat induction safety seals include, for example, foil seals, wax seals, cellophane seals, and seals made from a combination of these materials. These safety seals are difficult to remove from the mouth of the bottle without the aid of a sharp object such as a utility knife, particularly for individuals having limited dexterity. While it is common practice to attempt to push through the safety seal on a bottle mouth with one's thumb, the safety seal can be hard to break through, and once broken, the user's thumb undesirably comes into contact with the bottled contents.

Although tools are available to cut through safety seals, and some safety seals include peel-initiating or tear-initiating tabs, there is a need for a more convenient and reliable manner of facilitating removal of safety seals. Such peel-initiating or tear-initiating tabs can still be difficult to use and increase the manufacturing cost of the safety seals due, for example, to the additional cutting operations necessary to impart the tab to the seal and the measures needed to avoid application of adhesive to the undersurface of the tab.

SUMMARY

A cap for the mouth of a safety-sealed bottle, such as an injection molded child-proof safety cap, is provided with one or more seal-cutting fins on a top surface of the cap. A bottle, as used herein, includes not only bottles but also jugs and jars. A cap, as used herein, includes not only caps but also lids, covers, and tops such as bottle tops. The cap is preferably additionally provided with a plurality of mouth alignment ribs preferably arranged along the perimeter of the top surface of the cap. Alternately, a mouth alignment ring may be arranged along the entire circumference of the perimeter of the top surface of the cap. In use, once removed from the threaded mouth of the bottle, the cap is inverted. Using the mouth alignment ribs or the mouth alignment ring as a guide, the user then positions and centers the inverted cap on the lip of the mouth of the bottle. The user then applies downward force to the cap and rotates the cap relative to the bottle. Upon removal of the inverted cap from the lip of the mouth of the bottle, the safety seal, which has either been punctured or scored by the seal-cutting fins upon the rotation of the cap relative to the bottle, can then be easily removed by the user.

The seal-cutting fins taper from a dwell closest to the top of the cap to at least one, and preferably two, peak(s). The height of the peaks (i.e., the maximum height of the seal-cutting fins) off the top of the cap is less than the height of the mouth alignment ribs or the mouth alignment ring. In this manner, the seal-cutting fins have a lower profile than the mouth alignment ribs or the mouth alignment ring so that the seal-cutting fins do not poke the palm of a user's hand when the user presses down and turns the cap when upright to remove the cap from a bottle.

In some embodiments of the present disclosure, the cap is provided with one or more depressor fins on the top surface of the cap. The purpose of the depressor fin(s) is to prevent the user from puncturing or scoring the entire circumference of the safety seal because doing so can cause the safety seal to fall into the bottle. The depressor fin(s) taper to an apex that is rounded in order to impart a groove in, but avoid puncturing, the safety seal. The height of the apex of the depressor fin(s) is greater than the height of the peak(s) of the seal-cutting fin(s). As with the seal-cutting fins, the height of the apex (i.e., the maximum height of the depressor fin(s)) off the top of the cap is less than the height of the mouth alignment ribs or the mouth alignment ring to avoid feeling sharp to the palm of a user's hand when the user presses down and turns the cap when upright to remove the cap from a bottle.

In a preferred embodiment, the cap has a seal-cutting fin with a single peak and a single depressor fin. The depressor fin tapers to an apex that is rounded in order to impart a groove to, but avoid puncturing, the safety seal. The height of the apex of the depressor fin is greater than the height of the peak of the seal-cutting fin. The peak of the single seal-cutting fin is located approximately 180° from the apex of the depressor fin. When a user applies force and rotates the inverted cap after it has been positioned over the bottle, the depressor fin imparts or forms a groove in but does not puncture or score, the safety seal while the seal-cutting fin punctures and scores the safety seal for the first 180° of rotation. The depressor fin is located the same distance from an outer perimeter of the cap as the seal-cutting fin. For any rotation between 180° and 360°, the peak of the seal-cutting fin travels in the groove or depressed path in the safety seal imparted by the depressor fin and does not puncture or score the safety seal. As a result, only half of the circumference of the safety seal is punctured or scored, making it possible for a user to easily remove the safety seal without creating the risk that the safety seal will fall into the bottle.

In another preferred embodiment provided with a depressor fin, the cap has a seal-cutting fin that tapers in opposite annular directions from a dwell closest to the top of the cap to two peaks. This enables a user to rotate the cap in either direction to puncture or score the safety seal. The depressor fin tapers to an apex that is rounded in order to impart a groove in, but avoid puncturing, the safety seal. The height of the apex of the depressor fin is greater than the height of the peak of the seal-cutting fin. The apex of the depressor fin and the peaks of the seal-cutting fins are all located approximately the same radial distance from one another. When a user applies force and rotates the inverted cap after it has been positioned over the bottle, the depressor fin forms or imparts a groove in, but does not puncture or score, the safety seal while the seal-cutting fin punctures and scores the safety seal for the first 120° of rotation. The depressor fin is located the same distance from an outer perimeter of the cap as the seal-cutting fin. For any rotation between 120° and 360°, the leading peak of the seal-cutting fin travels in the depressed path or groove in the safety seal imparted by the depressor fin and does not puncture or score the safety seal. As a result, only one third of the circumference of the safety seal is punctured or scored, making it possible for a user to easily remove the safety seal without creating the risk that the safety seal will fall into the bottle.

In another preferred embodiment provided with a depressor fin, the cap has two short seal-cutting fins that each taper in opposite annular directions from the main planar surface of the top of the cap to a first peak, dip to a serration dwell, and then slant in a continuously sloping manner to at least a second peak. This enables a user to rotate the cap in either direction to puncture or score the safety seal. The depressor fin tapers to an apex that is rounded in order to impart a groove in, but avoid puncturing, the safety seal. The height of the apex of the depressor fin is greater than the height of the peak of the seal-cutting fin. The apex of the depressor fin is elongated such that the distance between at least a portion of the apex of the depressor fin and each of the outermost peaks of the two seal-cutting fins is 180°. When a user applies force and rotates the inverted cap after it has been positioned over the bottle, the depressor fin forms or imparts a groove in, but does not puncture or score, the safety seal while the seal-cutting fin punctures and scores the safety seal for the first 180° of rotation. The depressor fin is located the same distance from an outer perimeter of the cap as the seal-cutting fin. For any rotation between 180° and 360°, the leading peaks of the seal-cutting fin travel in the depressed path in the safety seal created by the depressor fin and do not puncture or score the safety seal. As a result, only half of the circumference of the safety seal is punctured or scored, making it possible for a user to easily remove the safety seal without creating the risk that the safety seal will fall into the bottle.

In another preferred embodiment provided with a depressor fin, the cap has a short seal-cutting fin that tapers in opposite annular directions from a dwell closest to the top of the cap to two peaks. This enables a user to rotate the cap in either direction to puncture or score the safety seal. The depressor fin tapers to an apex that is rounded in order to impart a groove in, but avoid puncturing, the safety seal. The height of the apex of the depressor fin is greater than the height of the peak of the seal-cutting fin. The apex of the depressor fin is elongated such that the distance between at least a portion of the apex of the depressor fin and each peak is 180°. When a user applies force and rotates the inverted cap after it has been positioned over the bottle, the depressor fin imparts or forms a groove in, but does not puncture or score, the safety seal while the seal-cutting fin punctures and scores the safety seal for the first 180° of rotation. The depressor fin is located the same distance from an outer perimeter of the cap as the seal-cutting fin. For any rotation between 180° and 360°, the leading peak of the seal-cutting fin travels in the depressed path in the safety seal created by the depressor fin and does not puncture or score the safety seal. As a result, only half of the circumference of the safety seal is punctured or scored, making it possible for a user to easily remove the safety seal without creating the risk that the safety seal will fall into the bottle.

DETAILED DESCRIPTION OF THE PREFERRED EMBODIMENTS

Figure 3:
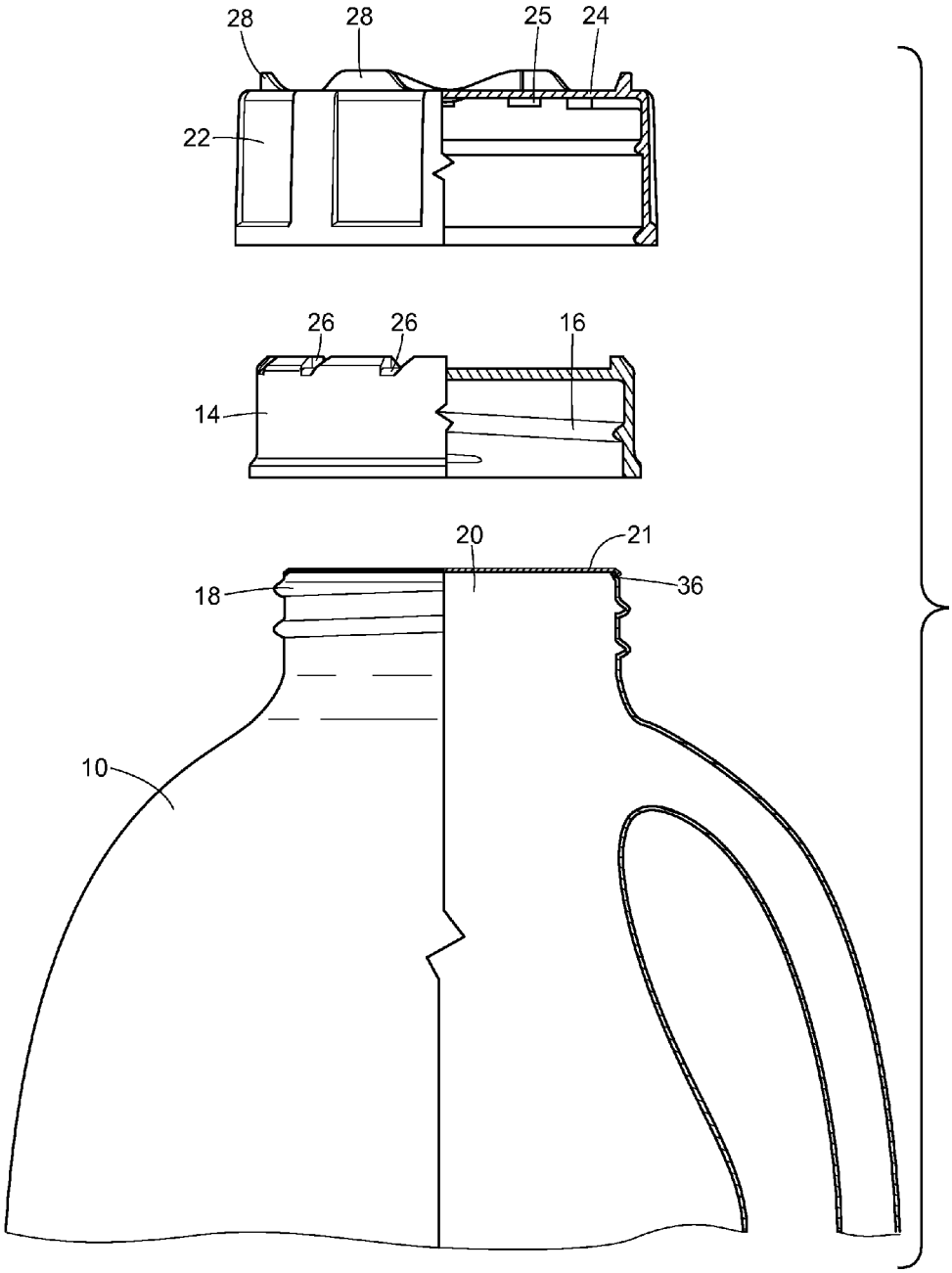
FIG. 3 is an exploded view of the bottle of FIG. 1 and the cap of FIG. 2, illustrated in partial cross-section.

As illustrated in the drawings, a bottle 10 is provided with a closure in the form of a cap 12. As illustrated in FIG. 3, the cap 12 may be a child-resistant safety cap having an inner stage 14 with a female-threaded portion 16 to selectively engage a male threaded portion 18 depending downwardly from the mouth 20 of a bottle 10 on which the cap 12 is to be secured, and an outer stage 22 that is rotatable relative to the inner stage 14 and the bottle 10 except when a downward force is applied to a top 24 of the outer stage 22 sufficient to push downwardly-depending tab members 25 provided in the outer stage 22 into engagement with complementary tab-receiving slots 26 provided on the inner stage 14. When so engaged, counter-clockwise rotation of the outer stage 22 of the cap 12 achieves counter-clockwise rotation of the inner stage 14 relative to the male threaded portion 18 of the bottle 10, permitting removal of the cap 12 from the bottle 10. Caps having such inner and outer stage features to increase resistance to unauthorized opening by children are known in the art.

The cap 12 of the present disclosure includes a plurality of mouth alignment ribs 28, or alternately a single mouth alignment ring 28*a*, arranged along the perimeter of the top 24 of the cap 12. The mouth alignment ribs 28 or the mouth alignment ring 28*a* project upwardly from the top 24 of the cap 12 when the inner stage 14 of the cap 12 is secured to the male threaded portion 18 of the mouth 18 of a bottle 10. The top 24 of the cap 12 further includes at least one, and preferably two, arcuate seal-cutting fins 30. In a preferred embodiment, each arcuate seal-cutting fin 30 tapers from a dwell 31 that is closest to a main planar surface 32 of the top 24 of the cap 12 to one or more peaks 34. Each of the arcuate seal-cutting fins 30 is preferably concentrically aligned with the outer perimeter of the cap 12. The top 24 of the cap 12 may further include at least one arcuate depressor fin 38. The arcuate depressor fin 38 is preferably concentrically aligned with the outer perimeter of the cap 12 and is located the same distance from the outer perimeter of the cap 12 as the arcuate seal-cutting fin 30. Further embodiments containing at least one arcuate depressor fin 38 are discussed in greater detail below.

The distance between the inner diameter of the mouth alignment ribs 28 or the mouth alignment ring 28*a* and the outer diameters of the arcuate seal-cutting fin(s) 30 and arcuate depressor fin(s) 38 is between 0.150-0.200 inch. A preferred embodiment has a distance of 0.170 inch. A distance in this range provides sufficient space for the lip 26 of the mouth 20 of the bottle 10 to be accommodated between the mouth alignment ribs 28 and the arcuate seal-cutting fin(s) 30 and arcuate depressor fin(s) 38. A distance in this range also ensures that when the inverted cap 12 is properly positioned on the mouth 20 of the bottle 10, the arcuate seal-cutting fin(s) 30 are close enough to the perimeter of the mouth 20 of the bottle 10 so as to be located where the safety seal 21 is best torn by the seal-cutting fin(s) 30 to facilitate pouring and tear-out of the remaining seal. If the arcuate seal-cutting fin(s) 30 are located too far from the mouth alignment ribs 28 or mouth alignment ring 28*a* (i.e., to close to the center of the cap), the cuts made into the safety seal 21 by the arcuate seal-cutting fin(s) 30 will not necessarily facilitate a user in removing the safety seal 21. For instance, an arcuate incision made by the arcuate seal-cutting fin(s) could cut with such a small radius as to be too small to initiate a proper tear to remove the remainder of the seal, and if the remainder of the seal is not removed, the incision may be too small to accommodate a smooth pour of fluid from the container. The arcuate seal-cutting fin(s) 30 and arcuate depressor fin(s) 38 preferably have a width between 0.045-0.050 inch. The depressor fin 38 may have a 1° to 2° draft angle where it connects to the top 24 of the cap 12.

The seal-cutting fin(s) 30 have a height at the peaks 34 (i.e., the maximum height of the seal-cutting fins 30) off the top 24 of the cap 12 that is less than a height of the mouth alignment ribs 28 or mouth alignment ring 28*a* off the top 24 of the cap 12. Likewise, any depressor fin 38 has a height at the apex 40 (i.e., the maximum height of the depressor fin 38) that is less than a height of the mouth alignment ribs 28 or mouth alignment ring 28*a* off the top 24 of the cap 12. In this manner, the seal-cutting fins 30 and any depressor fin 38 have a lower profile than the mouth alignment ribs 28 or mouth alignment ring 28*a*, so as not to feel sharp to, for example, the palm of a user's hand when pressing to turn the cap 12 when upright to remove the cap 12 from a bottle 10. The preferred range discussed earlier for the distance between the inner diameter of the mouth alignment ribs 28 or the mouth alignment ring 28*a* and the outer diameters of the arcuate seal-cutting fin(s) 30 and arcuate depressor fin(s) 38 is relevant for this purpose as well because it ensures that the mouth alignment ribs 28 or mouth alignment ring 28*a* are close enough to the arcuate seal-cutting fin(s) 30 and arcuate depressor fin(s) 38 to protect the user's hand. Preferably, each of the mouth alignment ribs 28 or the mouth alignment ring 28*a* has a maximum height of 0.085 inch off the top 24 of the cap 12, and the seal-cutting fins 30 have a maximum height (at their peaks 34) of 0.080 inch.

Figure 1:
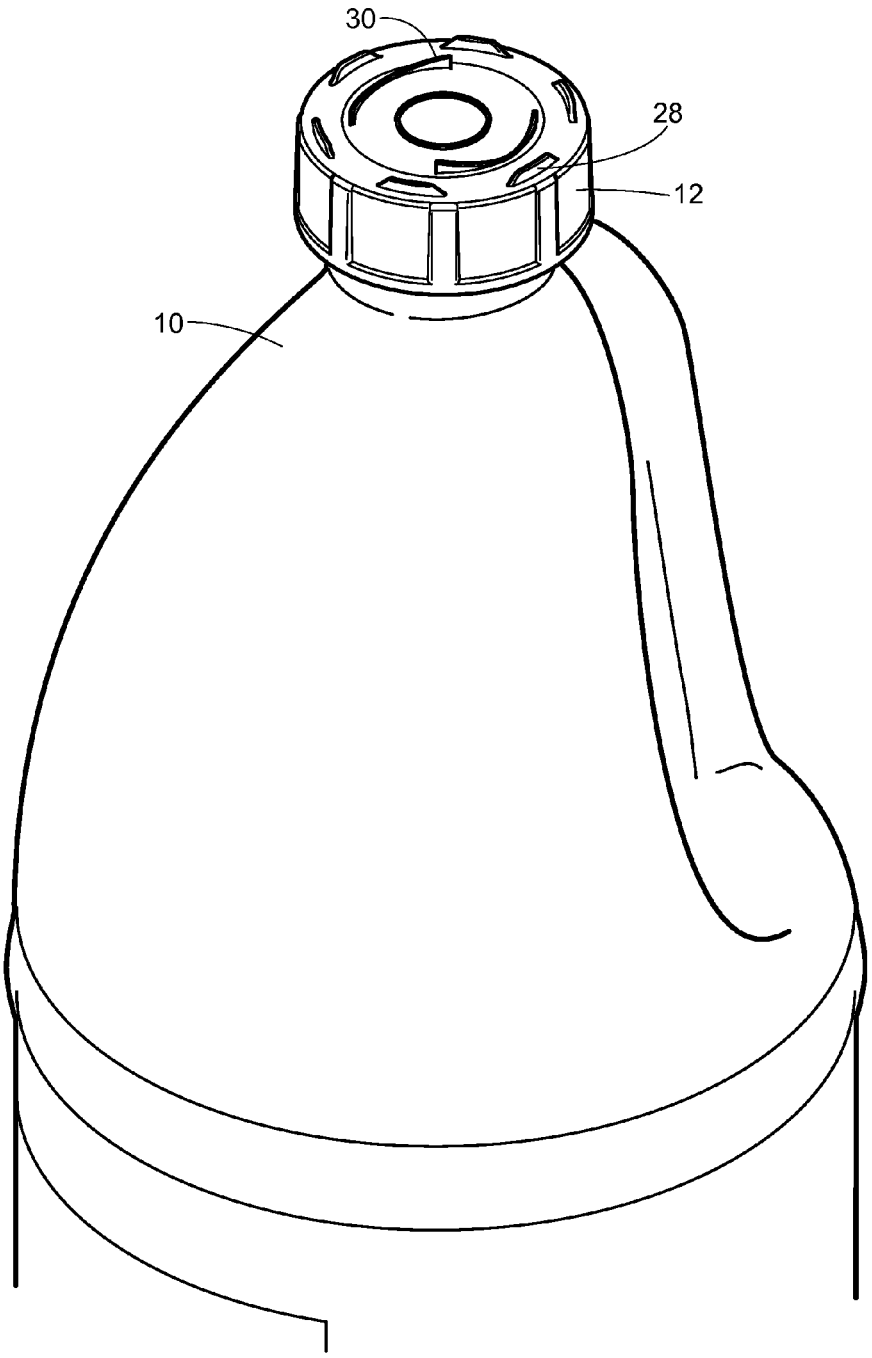
FIG. 1 is a top perspective view of a safety-sealed bottle having a cap of the present disclosure secured thereon.
Figure 2:
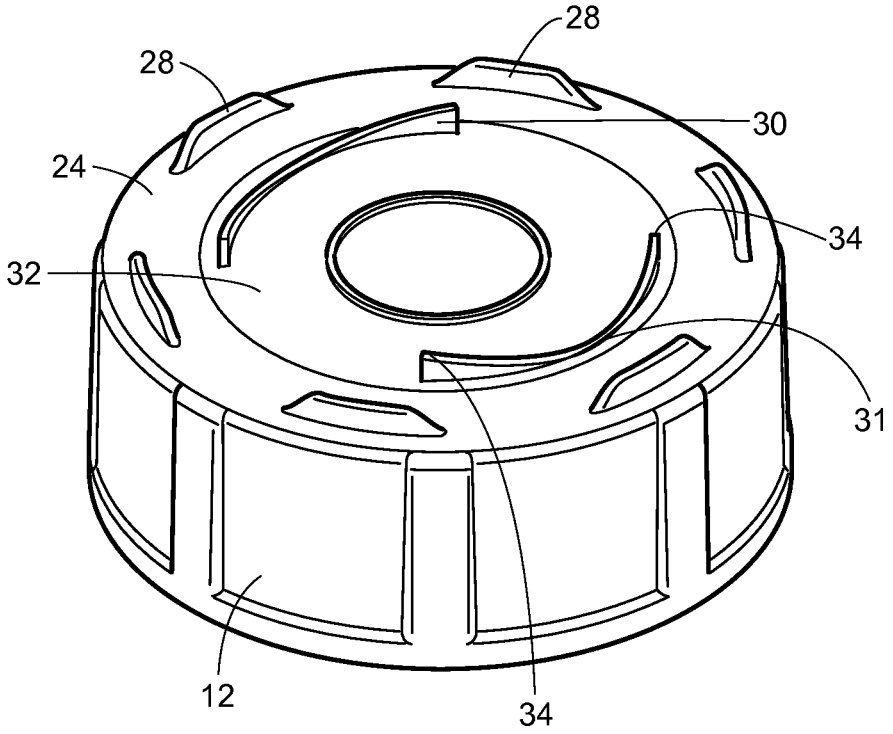
FIG. 2 is a top perspective view of a cap of the present disclosure.
Figure 4:
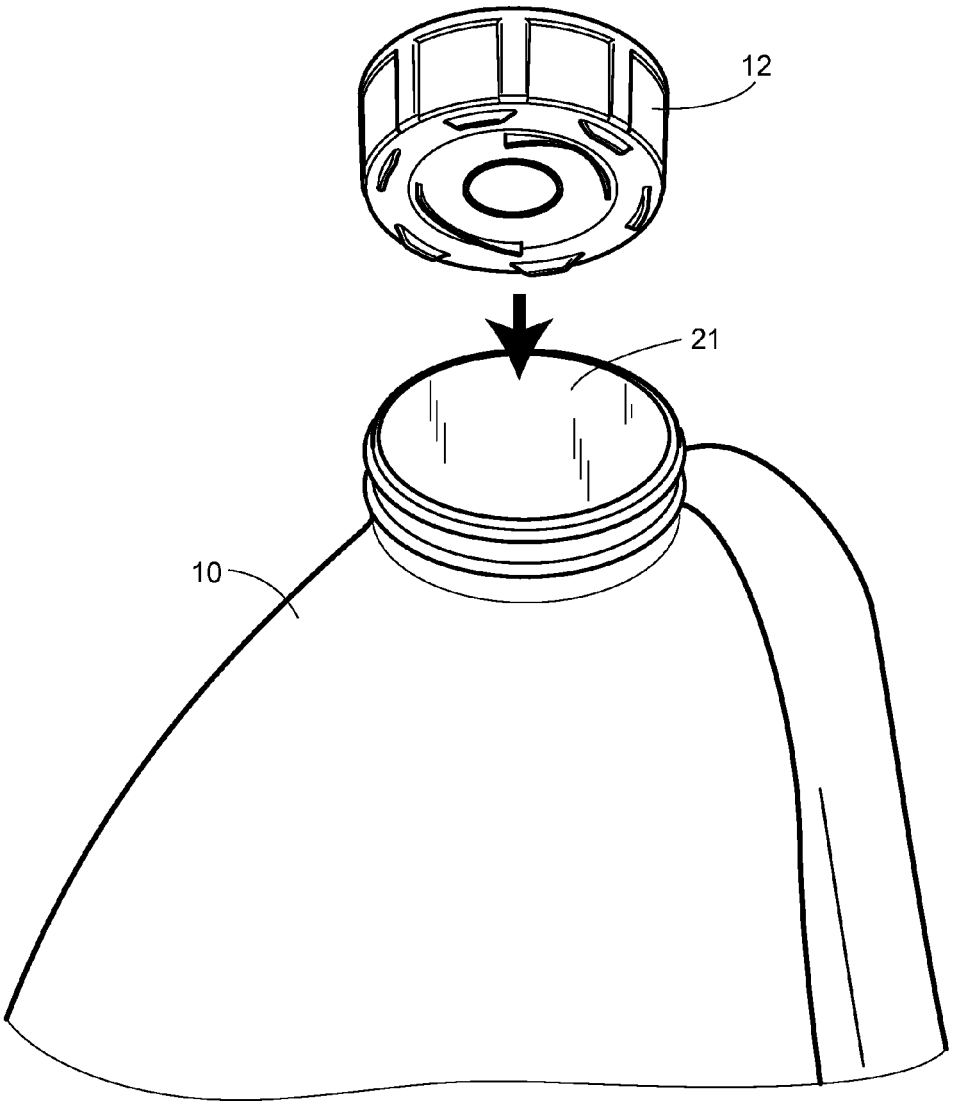
FIG. 4 is a top perspective view of the safety-sealed bottle of FIG. 1 wherein the cap of the present disclosure is inverted and is about to be positioned over the mouth of the bottle.

Upon removal of the cap 12 from the mouth 20 of a bottle 10, the cap 12 is inverted as illustrated in FIG. 4. The inverted cap 12 is then positioned centrally on a lip 36 of the mouth 20, such that the mouth alignment ring 28*a* or mouth alignment ribs 28 are positioned out-board of the lip 36 of the mouth 20. Each of the mouth alignment ribs 28 may have sloped sides and rounded corners to avoid sharp edges. While some purposes of the mouth alignment ribs 28 may be served by a mouth alignment ring 28*a* extending from the top of the cap, there are several benefits to providing a series of interrupted ribs. For instance, there is a savings of plastic material realized by providing a plurality of smaller mouth alignment ribs 28. Additionally, such a mouth alignment ring 28*a* is more prone than an interrupted series of mouth alignment ribs 28 to collect water or ice on the top of the cap 12, which may be undesirable. Preferably, at least three mouth alignment ribs 28 are provided with their centers offset 20°-135° from one another. More preferably, the mouth alignment ribs 28 define castellations on the top of the cap 12 having sloped sides and rounded corners, as illustrated in FIGS. 1 and 2. In a particularly preferred embodiment, eight mouth alignment ribs 28 are provided with their centers at 22.5° intervals around the perimeter of the cap 12. While the mouth alignment ribs 28 may be elongated, they may each alternately be in the form of a raised nub, hemispherical bump, cone, or other suitable structural shape that will facilitate positioning of the inverted cap 12 centrally on the lip 36 of the mouth 20.

Figure 5:
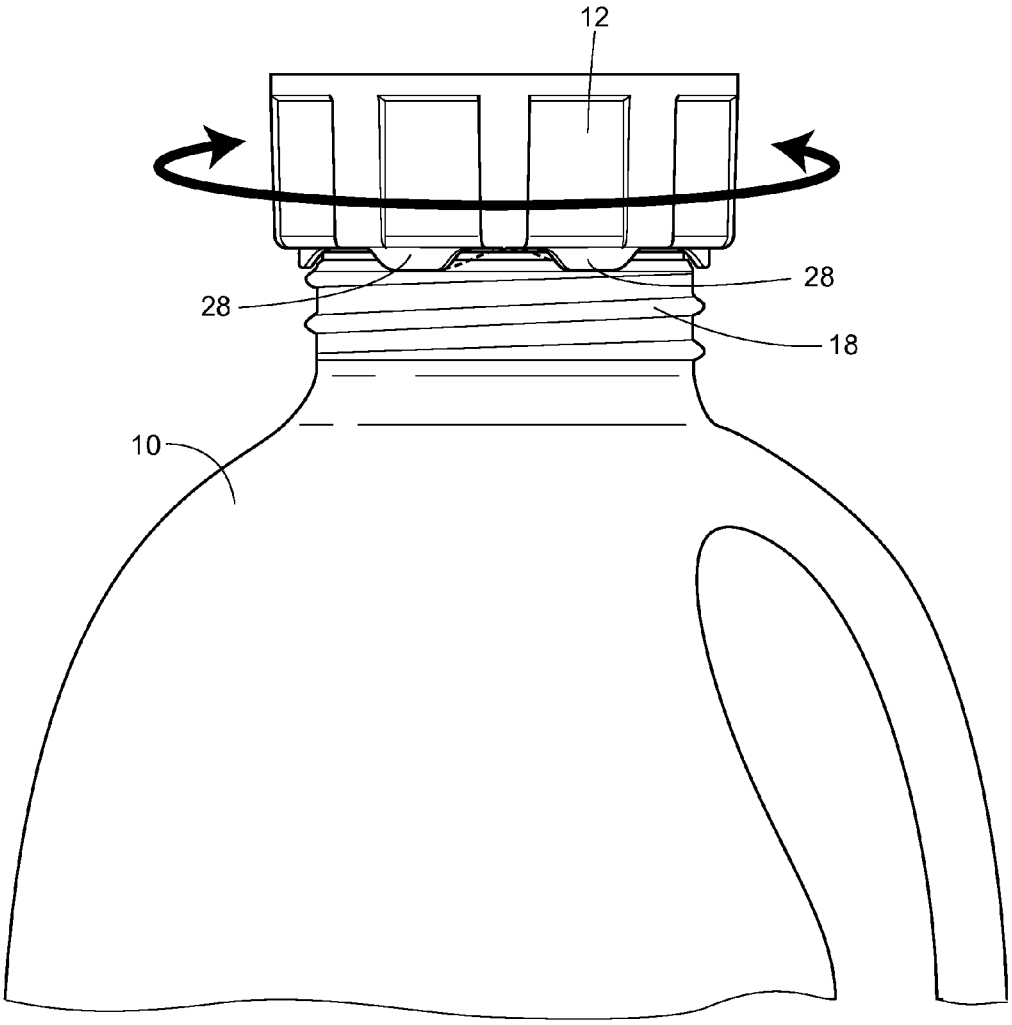
FIG. 5 is a front plan view of the safety-sealed bottle of FIG. 1 with the inverted cap of the present disclosure positioned over the mouth, the lip of the mouth positioned radially inwardly of mouth-alignment ribs of the cap, and illustrating rotation of the cap relative to the bottle.
Figure 6:
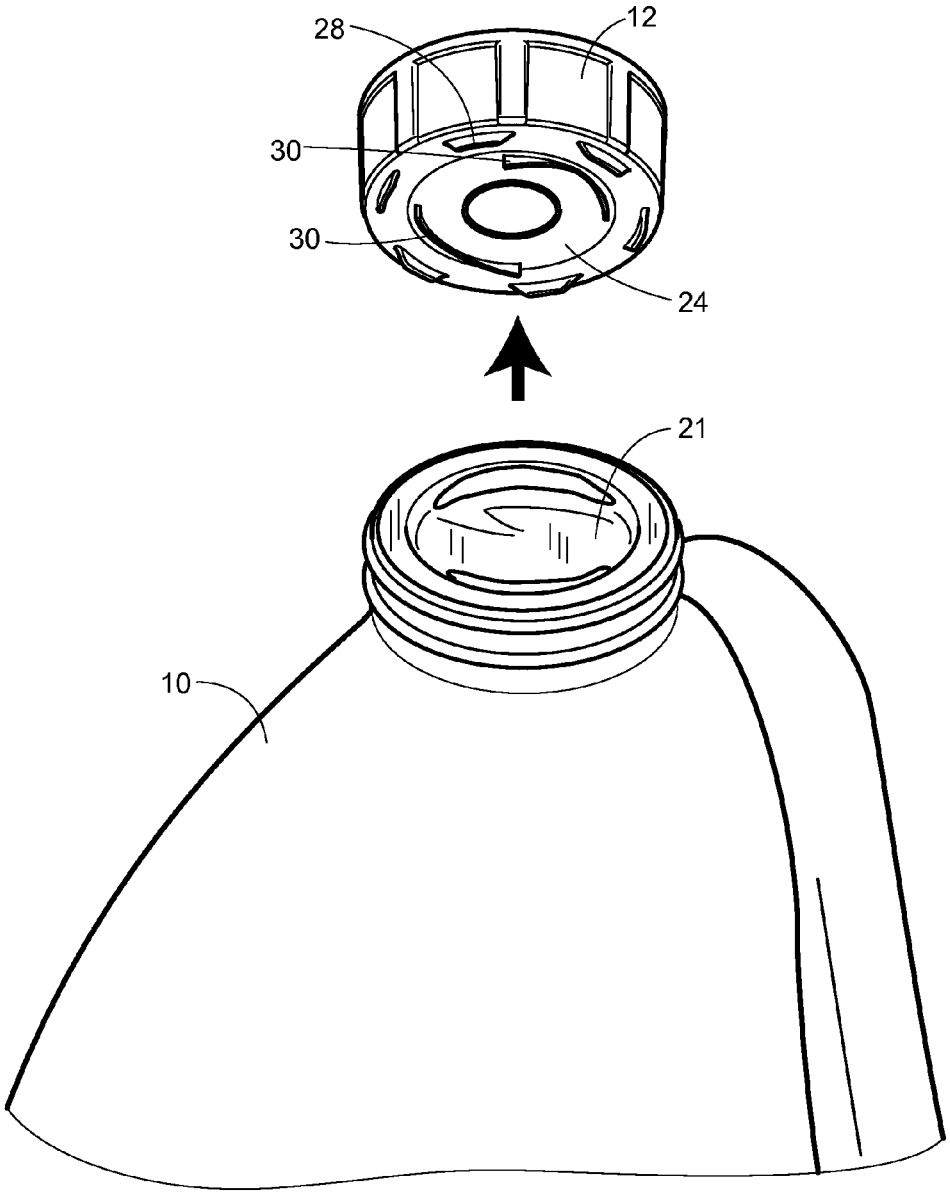
FIG. 6 is a top perspective view illustrating, upon removal of the inverted cap, that the safety seal is ruptured.

With the inverted cap 12 properly positioned on the mouth 20 of the bottle 10 such that the lip 36 is confined within the mouth alignment ring 28*a* or mouth alignment ribs 28, the arcuate seal-cutting fins 30 are positioned on the safety seal 21. By applying a downward force to the inverted cap 12 in the direction of the bottle 10 and twisting the inverted cap 12 (as illustrated in FIG. 5), the arcuate seal-cutting fins 30 score the safety seal 21, thereby weakening or puncturing the safety seal 21 (as illustrated in FIG. 6) and facilitating its ready removal from the mouth 20 of the bottle 10.

Figure 7:
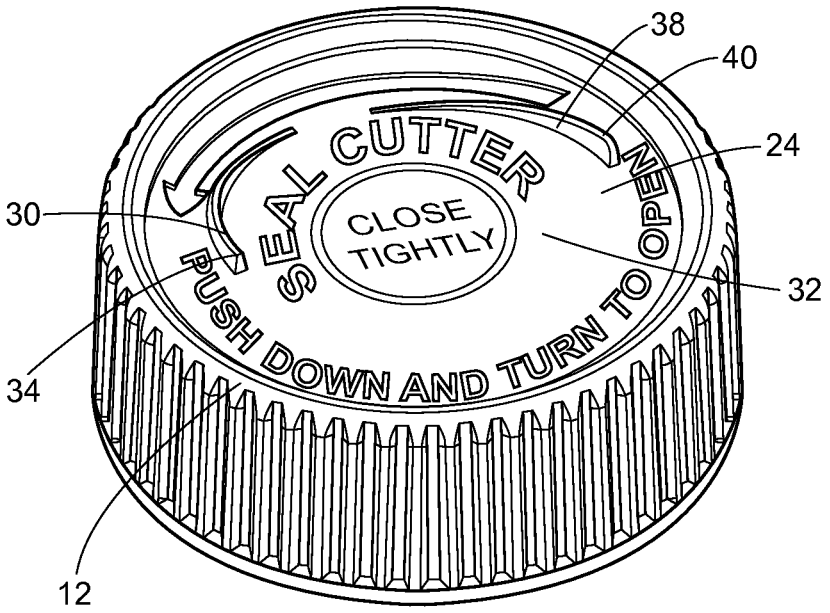
FIG. 7 is a top perspective view of a cap of the present disclosure having a seal-cutting fin with a single peak and a depressor fin, wherein the radial distance between the peak and the apex of the depressor fin is approximately 180°.

A preferred embodiment of the cap 12 having an arcuate depressor fin 38 is illustrated in FIG. 7. In this embodiment, the cap 12 comprises a single arcuate seal-cutting fin 30 that tapers from the main planar surface 32 of the top 24 of the cap 12 to a single peak 34. The cap 12 further comprises a single arcuate depressor fin 38 that tapers in the opposite direction of the arcuate seal-cutting fin 30 from the main planar surface 32 of the top 24 of the cap 12 to a single apex 40. The arcuate depressor fin 38 is preferably concentrically aligned with the outer perimeter of the cap 12 and is located the same distance from the outer perimeter of the cap 12 as the arcuate seal-cutting fin 30. The apex 40 of the arcuate depressor fin 38 is rounded and has a height greater than the height of the peak 34 of the arcuate seal-cutting fin 30. The apex 40 of the arcuate depressor fin 38 is preferably located approximately 180° from the peak 34 of the arcuate seal-cutting fin 30.

With the inverted cap 12 properly positioned on the mouth 20 of the bottle 10 such that the lip 36 is confined within the mouth alignment ring 28*a* or mouth alignment ribs 28, the arcuate seal-cutting fin 30 and the depressor fin 38 are positioned on the safety seal 21. When a downward force is applied to the inverted cap 12 and the inverted cap 12 is rotated, the arcuate seal-cutting fin 30 scores or punctures the safety seal 21 and the arcuate depressor fin 38 depresses the safety seal 21 without puncturing the safety seal 21 for the first 180° of rotation. For the second 180° of rotation, the peak 34 of the arcuate seal-cutting fin 30 travels in the depressed path in the safety seal 21 created by the arcuate depressor fin 38 and does not score or puncture the safety seal 21. During any rotation of the inverted cap 12 beyond 360°, the peak 34 of the arcuate seal-cutting fin 30 travels either in a portion of the safety seal 21 that has already been scored or punctured or else in the depressed path in the safety seal 21 created by the arcuate depressor fin 38. Consequently, a maximum of half of the circumference of the safety seal 21 is punctured or scored regardless of how many degrees a user rotates the inverted cap 12. This makes it possible for a user to easily remove the safety seal 21 on the bottle 10 so that the contents of the container may be removed or used, without creating the risk that the safety seal 21 will fall into the bottle 10.

Figure 8:
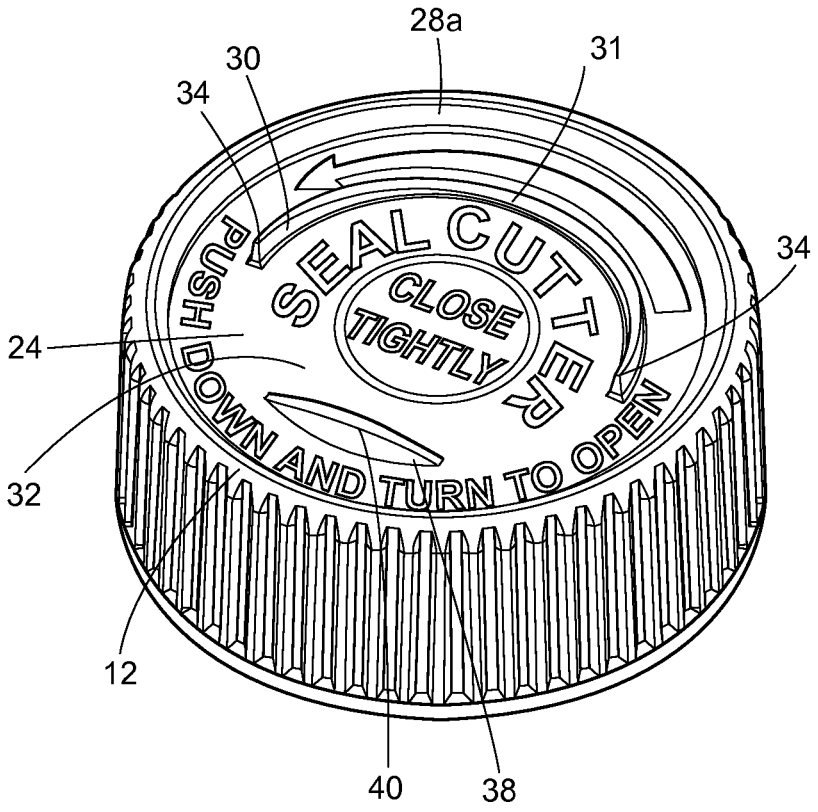
FIG. 8 is a top perspective view of a cap of the present disclosure having a seal-cutting fin with two peaks and a depressor fin, wherein the radial distance between the two peaks and the apex of the depressor fin is approximately 120°.

Another preferred embodiment of the cap 12 having an arcuate depressor fin 38 is illustrated in FIG. 8. In this embodiment, the cap 12 comprises an arcuate seal-cutting fin 30 that tapers in opposite annular directions from a central dwell 31 closest to a main planar surface 32 to two peaks 34. The cap 12 further comprises a single arcuate depressor fin 38 that tapers from the main planar surface 32 of the top 24 of the cap 12 to a single apex 40. The arcuate depressor fin 38 is preferably concentrically aligned with the outer perimeter of the cap 12 and is located the same distance from the outer perimeter of the cap 12 as the arcuate seal-cutting fin 30. The apex 40 of the arcuate depressor fin 38 is rounded and has a height greater than the height of the peaks 34 of the arcuate seal-cutting fin 30. The apex 40 of the arcuate depressor fin 38 and the peaks 34 of the arcuate seal-cutting fin 30 are located at the same radial distance, or 120°, from one another.

When a downward force is applied to the inverted cap 12 of this embodiment after it has been properly positioned on the mouth 20 of the bottle 10 and the inverted cap 12 is rotated, the leading peak 34 of the arcuate seal-cutting fin 30 in the direction of rotation scores or punctures the safety seal 21 and the arcuate depressor fin 38 depresses the safety seal 21 without puncturing the safety seal 21 for the first 120° of rotation. For the next 240° of rotation, the leading peak 34 of the arcuate seal-cutting fin 30 travels in the depressed path in the safety seal 21 created by the arcuate depressor fin 38 and does not score or puncture the safety seal 21. During any rotation of the inverted cap 12 beyond 360°, the leading peak 34 of the arcuate seal-cutting fin 30 travels either in a portion of the safety seal 21 that has already been scored or punctured or else in the depressed path in the safety seal 21 created by the arcuate depressor fin 38. Consequently, a maximum of one third of the circumference of the safety seal 21 is punctured or scored regardless of how many degrees a user rotates the inverted cap 12. This makes it possible for a user to easily remove the safety seal 21 on the bottle 10 so that the contents of the container may be removed or used, without creating the risk that the safety seal 21 will fall into the bottle 10.

Figure 9:
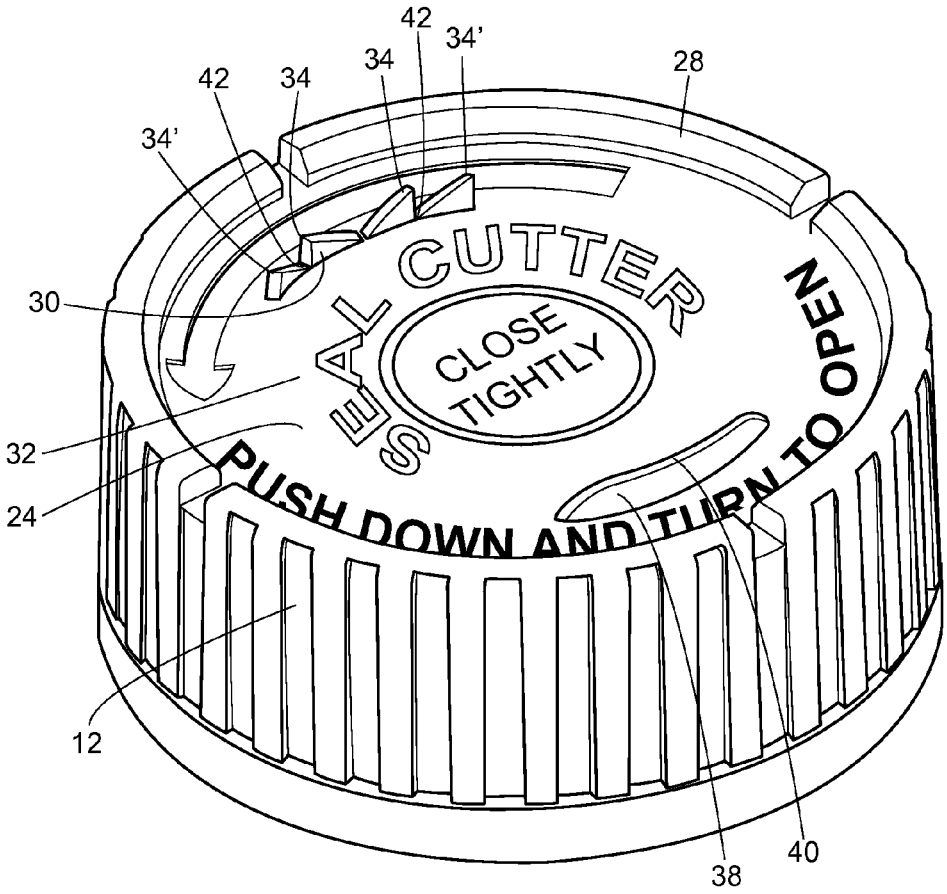
FIG. 9 is a top perspective view of a cap of the present disclosure having two seal-cutting fins with two peaks each and a depressor fin, where in the radial distance between the two outermost peaks of the two seal-cutting fins and the apex of the depressor fin is approximately 180°.

Another preferred embodiment of the cap 12 having an arcuate depressor fin 38 is illustrated in FIG. 9. In this embodiment, the cap 12 comprises two arcuate seal-cutting fins 30 that each taper in opposite annular directions from the main planar surface 32 of the top 24 of the cap 12 to at least a first peak 34, dip to a serration dwell 42, and then slant in a continuously sloping manner to at least a second peak 34'. The serration dwell 42 may be at or above the main planar surface 32 of the top 24 of the cap 12. The cap 12 further comprises a single arcuate depressor fin 38 that tapers from main planar surface 32 of the top 24 of the cap 12 to a single apex 40. The arcuate depressor fin 38 is preferably concentrically aligned with the outer perimeter of the cap 12 and is located the same distance from the outer perimeter of the cap 12 as the arcuate seal-cutting fins 30. The apex 40 of the arcuate depressor fin 38 has a height greater than the height of the peaks 34 and 34' of the arcuate seal-cutting fins 30. The two arcuate seal-cutting fins 30 are short enough in length and the apex 40 of the arcuate depressor fin 38 is elongated enough to allow the outermost peaks 34' of the seal-cutting fins 30 to be approximately 180° from some portion of the apex 40 of the arcuate depressor fin 38.

When a downward force is applied to the inverted cap 12 of this embodiment after it has been properly positioned on the mouth 20 of the bottle 10 and the inverted cap is rotated, the leading two peaks 34 and 34' of the leading arcuate seal-cutting fin 30 in the direction of rotation score or puncture the safety seal 21 and the arcuate depressor fin 38 depresses the safety seal 21 without puncturing the safety seal 21 for the first 180° degrees of rotation. For the second 180° of rotation, the leading peaks 34 and 34' of the leading arcuate seal-cutting fin 30 travel in the depressed path in the safety seal 21 created by the arcuate depressor fin 38 and do not score or puncture the safety seal 21. During any rotation of the inverted cap 12 beyond 360°, the leading peaks 34 and 34' of the leading arcuate seal-cutting fin 30 travel either in a portion of the safety seal 21 that has already been scored or punctured or else in the depressed path in the safety seal 21 created by the arcuate depressor fin 38. Consequently, a maximum of half of the circumference of the safety seal 21 is punctured or scored regardless of how many degrees a user rotates the inverted cap 12. This makes is possible for a user to easily remove the safety seal 21 on the bottle 10 so that the contents of the container may be removed or used, without creating the risk that the safety seal 21 will fall into the bottle 10.

Figure 10:
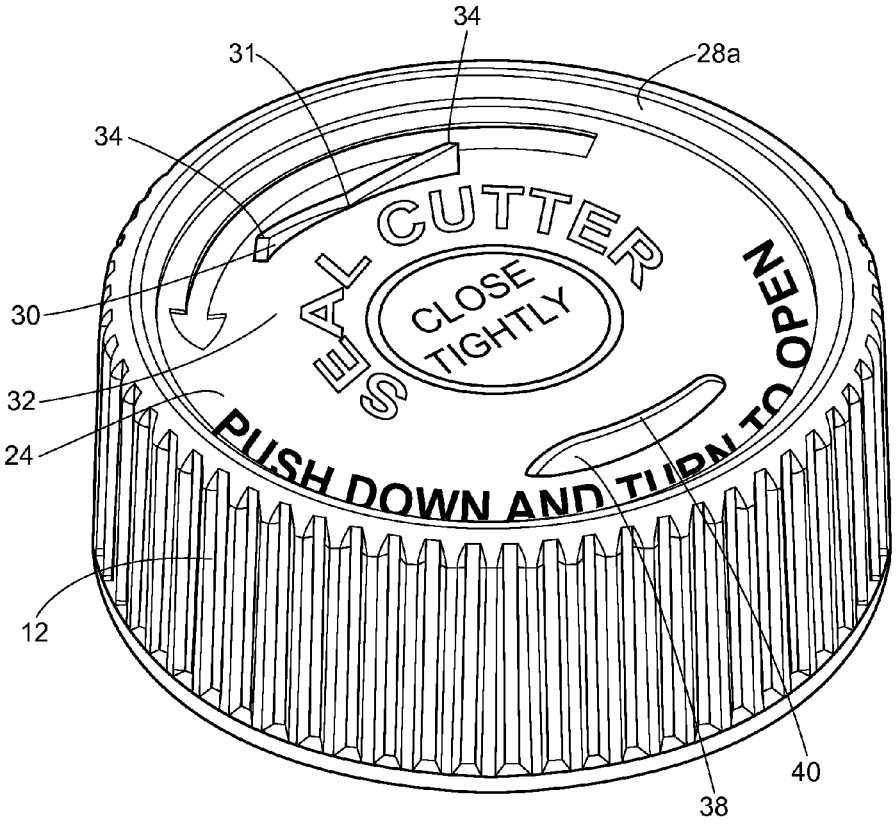
FIG. 10 is a top perspective view of a cap of the present disclosure having a seal-cutting fin with two peaks and a depressor fin, wherein the radial distance between the two peaks and the apex of the depressor fin is approximately 180°.

Another preferred embodiment of the cap 12 having an arcuate depressor fin 38 is illustrated in FIG. 10. In this embodiment, the cap 12 comprises an arcuate seal-cutting fin 30 that tapers in opposite annular directions from a central dwell 31 closest to a main planar surface 32 to two peaks 34. The cap 12 further comprises a single arcuate depressor fin 38 that tapers from main planar surface 32 of the top 24 of the cap 12 to a single apex 40. The arcuate depressor fin 38 is preferably concentrically aligned with the outer perimeter of the cap 12 and is located the same distance from the outer perimeter of the cap 12 as the arcuate seal-cutting fin 30. The apex 40 of the arcuate depressor fin 38 has a height greater than the height of the peaks 34 of the arcuate seal-cutting fin 30. The arcuate seal-cutting fin 30 is short enough in length and the apex 40 of the arcuate depressor fin 38 is elongated enough to allow both peaks 34 of the seal-cutting fin 30 to be approximately 180° from some portion of the apex 40 of the arcuate depressor fin 38.

When a downward force is applied to the inverted cap 12 of this embodiment after it has been properly positioned on the mouth 20 of the bottle 10 and the inverted cap is rotated, the leading peak 34 of the arcuate seal-cutting fin 30 in the direction of rotation scores or punctures the safety seal 21 and the arcuate depressor fin 38 depresses the safety seal 21 without puncturing the safety seal 21 for the first 180° degrees of rotation. For the second 180° of rotation, the leading peak 34 of the arcuate seal-cutting fins 30 travels in the depressed path in the safety seal 21 created by the arcuate depressor fin 38 and does not score or puncture the safety seal 21. During any rotation of the inverted cap 12 beyond 360°, the leading peak 34 of the arcuate seal-cutting fin 30 travels either in a portion of the safety seal 21 that has already been scored or punctured or else in the depressed path in the safety seal 21 created by the arcuate depressor fin 38. Consequently, a maximum of half of the circumference of the safety seal 21 is punctured or scored regardless of how many degrees a user rotates the inverted cap 12. This makes is possible for a user to easily remove the safety seal 21 on the bottle 10 so that the contents of the container may be removed or used, without creating the risk that the safety seal 21 will fall into the bottle 10.

While the present disclosure has been described with respect to certain embodiments, it will be understood that variations may be made thereto that are still within the scope of the appended claims.

What is claimed is:

1. A cap for use with bottles having a heat induction sealed mouth, the cap comprising a top, the cap being threadedly engageable with a mouth of a bottle, and at least one arcuate seal-cutting fin projecting from the top of the cap, further comprising a at least one arcuate depressor fin projecting from the top of the cap, wherein each of the at least one arcuate depressor fins includes at least one rounded apex, wherein each of the at least one arcuate depressor fins is concentrically aligned with a perimeter of the cap, wherein each of the at least one arcuate seal-cutting fins is concentrically aligned with the perimeter of the cap and is located the same distance from the perimeter of the cap as the at least one arcuate depressor fins, and wherein the height of each of the at least one arcuate depressor fins is greater than the height of each of the at least one arcuate seal-cutting fins.

2. The cap of claim 1, further comprising one mouth alignment ring or one or more mouth alignment ribs projecting from the top of the cap.

3. The cap of claim 2, wherein the distance between an inner diameter of the one mouth alignment ring or the one or more mouth alignment ribs and an outer diameter of the at least one arcuate seal-cutting fin is between 0.150 and 0.200 inch.

4. The cap of claim 2, including at least three of the mouth alignment ribs, the center of each of the mouth alignment ribs being disposed in a range of 20 to 135 degrees from another of the mouth alignment ribs.

5. The cap of claim 2, including a plurality of the mouth alignment ribs that define castellations on the top of the cap 12.

6. The cap of claim 5, wherein each of the plurality of mouth alignment ribs has sloped sides.

7. The cap of claim 5, wherein each of the plurality of mouth alignment ribs has rounded corners.

8. The cap of claim 2, wherein the cap comprises one arcuate seal-cutting fin that tapers from the main planar surface of the top to a single peak.

9. The cap of claim 8, wherein the cap comprises one arcuate depressor fin and the rounded apex of the arcuate depressor fin is 180 degrees from the single peak of the arcuate seal-cutting fin.

10. The cap of claim 2, wherein the cap comprises one arcuate seal-cutting fin that includes a central dwell portion closest to a main planar surface of the top and two peaks.

11. The cap of claim 10, wherein the cap comprises one arcuate depressor fin, and the rounded apex of the arcuate depressor fin and the two peaks of the arcuate-seal-cutting fin are located 120 degrees from one another.

12. The cap of claim 10, wherein the cap comprises one arcuate depressor fin, and the rounded apex of the arcuate depressor fin is elongated such that the two peaks of the arcuate-seal-cutting fin are located 180 degrees from a portion of the rounded apex.

13. The cap of claim 2, wherein the cap comprises two arcuate seal-cutting fins each including at least one serration dwell and at least two peaks.

14. The cap of claim 13, wherein the cap comprises one arcuate depressor fin, and the rounded apex of the arcuate depressor fin is elongated such that an outermost peak of each arcuate seal-cutting fin is located 180 degrees from a portion of the rounded apex.

15. A cap for use with bottles having a heat induction sealed mouth, the cap comprising an inner stage that is threadedly engageable with a mouth of a bottle, and an outer stage selectively rotatable relative to the inner stage and at least one arcuate seal-cutting fin projecting from the top of the cap, the outer stage including a top having at least one arcuate seal-cutting fin projecting from the top of the cap, further comprising one mouth alignment ring or one or more mouth alignment ribs projecting from the top, further comprising a at least one arcuate depressor fin projecting from the top of the cap, wherein each of the at least one arcuate depressor fins includes at least one rounded apex, wherein each of the at least one arcuate depressor fins is concentrically aligned with a perimeter of the cap, wherein each of the at least one arcuate seal-cutting fins is concentrically aligned with the perimeter of the cap and is located the same distance from the perimeter of the cap as the at least one arcuate depressor fins, and wherein the height of each of the at least one arcuate depressor fins is greater than the height of each of the at least one arcuate seal-cutting fins.

16. The cap of claim 15, wherein the cap comprises one arcuate seal-cutting fin that tapers from the main planar surface of the top to a single peak.

17. The cap of claim 16, wherein the cap comprises one arcuate depressor fin and the rounded apex of the arcuate depressor fin is 180 degrees from the single peak of the arcuate seal-cutting fin.

18. The cap of claim 15, wherein the cap comprises one arcuate seal-cutting fin that includes a central dwell portion closest to a main planar surface of the top and two peaks.

19. The cap of claim 18, wherein the cap comprises one arcuate depressor fin, and the rounded apex of the arcuate depressor fin and the two peaks of the arcuate-seal-cutting fin are located 120 degrees from one another.

20. The cap of claim 18, wherein the cap comprises one arcuate depressor fin, and the rounded apex of the arcuate depressor fin is elongated such that the two peaks of the arcuate-seal-cutting fin are located 180 degrees from a portion of the rounded apex.

21. The cap of claim 15, wherein the cap comprises two arcuate seal-cutting fins each including at least one serration dwell and at least two peaks.

22. The cap of claim 21, wherein the cap comprises one arcuate depressor fin, and the rounded apex of the arcuate depressor fin is elongated such that an outermost peak of each arcuate seal-cutting fin is located 180 degrees from a portion of the rounded apex.

* * * * *